US006165282A

United States Patent [19]

Marshall et al.

[11] Patent Number: 6,165,282

[45] **Date of Patent: *Dec. 26, 2000**

[54] METHOD FOR CONTAMINANT REMOVAL USING NATURAL CONVECTION FLOW AND CHANGES IN SOLUBILITY CONCENTRATION BY TEMPERATURE

[75] Inventors: Mary C. Marshall, San Antonio, Tex.; John G. Franjione, Kingsport, Tenn.; Christopher J. Freitas, San Antonio, Tex.

[73] Assignee: Southwest Research Institute, San Antonio, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/674,702

[22] Filed: Jul. 8, 1996

Related U.S. Application Data

[60] Continuation-in-part of application No. 08/348,035, Dec. 1, 1994, Pat. No. 5,533,538, which is a division of application No. 07/906,557, Jun. 30, 1992, Pat. No. 5,401,322.

[51] Int. Cl.[7] ..... B08B 7/04; B08B 5/00; B08B 7/00

[52] U.S. Cl. ..... 134/13; 134/10; 134/11; 134/13; 134/19

[58] Field of Search ..... 134/19, 10, 1, 134/35, 13; 210/634, 198.2, 656

[56] References Cited

U.S. PATENT DOCUMENTS

| | | | |
|---|---|---|---|
| 3,868,326 | 2/1975 | Talley, Jr. | 210/377 |
| 4,302,273 | 11/1981 | Howard, Jr. | 156/345 |
| 4,594,164 | 6/1986 | Titmas | 210/741 |
| 4,764,317 | 8/1988 | Anderson et al. . | |
| 4,792,408 | 12/1988 | Titmas | 210/747 |
| 4,810,264 | 3/1989 | Dewitz | 48/210 |
| 5,254,598 | 10/1993 | Schlameus et al. . | |
| 5,348,803 | 9/1994 | Schlaemus et al. . | |
| 5,360,976 | 11/1994 | Young et al. . | |
| 5,401,322 | 3/1995 | Marshall . | |
| 5,463,220 | 10/1995 | Young et al. . | |
| 5,533,538 | 7/1996 | Marshall . | |

FOREIGN PATENT DOCUMENTS

| | | | |
|---|---|---|---|
| 0 333 946 | 9/1989 | European Pat. Off. . | |
| 0 397 826 | 11/1990 | European Pat. Off. | B08B 7/00 |
| 1476174 | 4/1989 | U.S.S.R. . | |

*Primary Examiner*—Frankie L. Stinson
*Assistant Examiner*—Yolanda E. Wilkins
*Attorney, Agent, or Firm*—Paula D. Morris & Associates P.C.

[57] ABSTRACT

Apparatus and methods are described for removing contaminants from an article using a supercritical or near supercritical solvent fluid held at substantially constant pressure in a pressure vessel. The article to be cleaned is first contacted with a solvent fluid in which the contaminant is soluble at a first supercritical or near-supercritical temperature. The contaminate-containing fluid is then cooled or heated to a second supercritical or near supercritical temperature to lower the solubility of the contaminant in the supercritical fluid and thereby precipitate or phase separate the contaminant. The contaminant is then recovered. Movement of the solvent fluid within the pressure vessel is preferably by convection induced by heating and cooling means in the vessel.

21 Claims, 2 Drawing Sheets

METHOD FOR CONTAMINANT REMOVAL USING NATURAL CONVECTION FLOW AND CHANGES IN SOLUBILITY CONCENTRATION BY TEMPERATURE

This application is a continuation-in-part of application Ser. No. 08/348,035 filed Dec. 1, 1994, now U.S. Pat. No. 5,533,538 which is a divisional of application Ser. No. 07/906,557 filed Jun. 30, 1992, now U.S. Pat. No. 5,401,322, issued Mar. 28, 1995.

The U.S. Government has a nonexclusive, nontransferable, irrevocable paid-up license to practice or have practiced this invention for or on its behalf as provided under the terms of Contract No. F33615-95-D-5615 with Science Applications International Corporation for the Department of the Air Force, awarded by the U.S. Government.

BACKGROUND

Field of the Invention

The invention relates to methods and apparatus for cleaning articles using supercritical and/or near-supercritical fluids. In particular, the present invention relates to using differences in contaminant solubility and solvent density at various temperatures and/or pressures to effect cleaning action, to influence solvent and/or contaminant movement in cleaning apparatus, and to facilitate concentration of contaminants within cleaning apparatus and their subsequent removal.

Cleaning Using Solvent Action It has long been known to use solvents in removing organic and inorganic contaminants from articles. In such processes, the contaminated article to be cleaned is contacted with the solvent to solubilize and remove the contaminant. In a vapor degreaser, subsequent evaporation of the solvent separates the solvent and the contaminant, and the solvent vapors are redirected to the article to further clean it. The contaminant is typically concentrated in the evaporation step, being removed as a precipitate, a separate liquid phase, or as a concentrated solution in the original solvent.

An example of the above process is described in U.S. Pat. No. 1,875,937, issued Sep. 6, 1932 to Savage. Grease is removed from the surface of metal castings and other nonabsorbent bodies by means of solvents, while contaminants collect in the bottom of the apparatus and are drawn off from time to time through a valve.

One of the drawbacks of this type of cleaning process is that the cooling surfaces also have a tendency to condense water out of the atmosphere in addition to cooling and condensing the solvent. This condensed water then becomes associated with the solvent and thus comes into contact with the metal parts of the cleaning apparatus and with the article being cleaned.

U.S. Pat. No. 2,123,439, issued Jul. 12, 1938, to Savage, describes how this problem of condensing water with the solvent may be overcome by first contacting the atmosphere with condensing surfaces at a temperature above the dew point of the atmosphere in which the operation is being carried out, but substantially below the condensing temperature of the solvent. The condensed solvent is drawn off for use in the cleaning process, while the remaining vapors are brought into contact with still cooler surfaces (cooler than the dew point) to condense out the water so it can be removed.

An alternative to the above process of condensing the solvent on a cold surface and then contacting the article to be cleaned with condensed solvent is to cool the article itself. For example, U.S. Pat. No. 3,663,293, issued May 16, 1972, to Surprenant et al., describes how the degreasing of metal parts may be accomplished by generating vapors of a solvent from a liquid sump, establishing a desired level of solvent vapor by adjusting the temperature of condensing means, and introducing a contaminated cold article into the solvent vapors, thereby causing the vapor to condense on the article. Condensate containing the contaminant falls from the article into the sump, and the article is removed from the solvent vapor when its temperature reaches the solvent vapor temperature (thus precluding further solvent condensation on the article).

Cleaning Using Supercritical Fluids

In an effort to improve on vapor degreasing methods, supercritical (and near-supercritical) fluids have been used as solvents to clean contaminants from articles. NASA Tech Brief MFS-29611 (Dec. 1990), describes the use of supercritical $CO_2$ as an alternative for hydrocarbon solvents conventionally used for washing organic and inorganic contaminants from the surfaces of metal parts.

A typical supercritical fluid cleaning process involves contacting the part to be cleaned with a supercritical fluid. The supercritical fluid, having solubilized contaminants and thus removing them from the part, then flows to a zone of lower pressure through an expansion valve. This depressurization causes the solvent fluid's state to change from supercritical to subcritical, resulting in separation of the solute (that is, the contaminant) from the solvent. Relieved of its burden of contaminant, the cleaned solvent fluid is then compressed back to a supercritical state and again brought into contact with the part if further cleaning is desired.

A different approach to cleaning with supercritical fluids is described in U.S. Pat. No. 4,944,837, issued Jul. 31, 1990 to Nishikawa et al. The method is applied to cleaning a silicon wafer in an atmosphere of supercritical carbon dioxide which contacts the wafer to solubilize the contaminant. After cleaning is complete, carbon dioxide is cooled to below its supercritical temperature (i.e., the system pressure is reduced and the carbon dioxide attains equilibrium between the liquid and gas phases) before removal of the cleaned wafer from the apparatus.

While effective, these processes are relatively inefficient because of the energy consumed in each pressurization-depressurization cycle. Further energy losses and increases in equipment complexity are associated with moving the solvent through the apparatus in both supercritical and subcritical states.

SUMMARY OF THE INVENTION

The present invention (an improved cleaner using supercritical and/or near-supercritical fluids) includes an apparatus which avoids or reduces several of the shortcomings noted above by keeping the solvent fluid in a supercritical or near-supercritical state in a pressure vessel throughout the cleaning and contaminant removal process. The pressure vessel comprises sealable access means to the vessel interior such as a door, lid, pressure lock, hatch, valve, etc. Note that a pressure lock may itself comprise a pressure vessel. Sealable access means may also comprise ports to introduce and/or remove articles to be cleaned, to remove (and if desired, recover) concentrated contaminants (including contaminated solvents), and to replenish the solvent as needed. Note that cosolvents and/or adjuvants which may be present as components in a solvent fluid may or may not also be in a supercritical state during normal operation of the cleaner.

Solubilized contaminants are concentrated and recovered through use of heating and/or cooling means within the pressure vessel which cause temperature changes in a solvent fluid which change contaminant solubility in the fluid. Even during contaminant recovery in the above improved cleaner, however, the solvent fluid remains in a supercritical or near-supercritical state. Consequently, the energy consumption is reduced (and efficiency is increased) over existing cleaners in which the solvent must be heated to account for enthalpy losses upon depressurization and compression to recycle the solvent and use it in the supercritical state.

In preferred embodiments of the improved cleaner, mechanical pumps are virtually unnecessary (initial pressurization and replacement of solvent fluid during operation can simply be accomplished by heating liquid carbon dioxide) because bulk-flow and micro-flow convection currents provide the desired fluid circulation. Additionally, because of the large density changes with low temperature differences and the low viscosity, supercritical fluids can move very quickly in response to relatively small temperature differences in different fluid zones. Such rapid solvent fluid movements, however, are detrimental to creating relatively large temperature differences within the solvent fluid necessary to effect large solubility differences within the supercritical fluid thereby diminishing the internal cleaning/recycling functionality of the invention. The rapid movement of the supercritical fluid past a heat exchanger surface reduces the amount of heat transfer; greater temperature differentials between the fluid and heat exchanger surface aggravates the problem. A solution is to increase the effective area for heat transfer by providing more contact time with the supercritical fluid by altering the fluid flow patterns through use of insulated baffle means.

In certain preferred embodiments, heat pumps may be used to maintain a desired temperature differential between heating zones (containing, for example, one or more heating means) which are spaced apart from cooling zones (containing, for example, one or more cooling means). In such cases, the cooling means would comprise, for example, the heat pump evaporator coils, while heating means would comprise, for example, the heat pump condenser coils. Auxiliary heating and cooling will be needed since 100% thermal efficiency cannot be achieved. Heating and cooling means may also include passive radiators thermally coupled to ambient fluids such as air (the stainless steel pressure vessel walls conduct large quantities of heat from the supercritical fluid necessitating insulation of the hot zone to achieve improved temperature control). Thermoelectric devices such as resistance heaters (for heating) and Peltier devices (for heating and/or cooling) have been successfully employed in the experimental operation of this invention. Peltier devices in particular may be employed to establish or augment a desired temperature difference across a baffle, thus providing a functional equivalent of insulated baffle means. For purposes of the present invention, insulated baffle means comprise such combinations of Peltier devices and baffles. Hence, convective fluid flow in improved cleaners of the present invention may be easily reversed in whole or in part by reversal of current flow in one or more Peltier junctions within the pressure vessel provided the proper configuration for exploiting the gravitational forces is used; such real-fime modulations may be beneficial for localized supercritical fluid currents to dislodge, relocate, or separate contaminants from the part and out of the solvent.

Control of either bulk or micro convective fluid movements in the above improved cleaner is preferably facilitated by insulated baffle means (to direct or channel the fluid stream flow). Insulated baffle means generally separate portions of moving fluid streams from portions of other moving fluid streams, wherein a temperature difference exists between the separated portions. The baffle insulation should be such that the heat transfer by conduction across the baffle is much less than the heat transfer by convection of the supercritical fluid moving between the hot and cold zones. This criterion is necessary to encourage the desired mass transfer (i.e., means to move clean supercritical fluid to the part and contaminants from the part) while also providing a large temperature difference between fluid zones to effect separation of the contaminant from the supercritical fluid. Note that insulated baffle means separate only portions of fluid streams. That is, fluid stream separation is not total but merely sufficient to maintain a desired temperature difference between portions of (preferably at least partly supercritical) solvent fluid streams to facilitate convective fluid flow and/or to achieve or maintain desired conditions of solubility or insolubility of one or more contaminants in a solvent fluid.

Insulated baffle means of the above improved cleaner comprise at least one space-occupying rigid or semi-rigid baffle structure which in use separates portions of at least two moving fluid streams comprising supercritical and/or near supercritical fluid, wherein a temperature difference exists between portions of at least two of the separated fluid streams. In practice, insulated baffle means can comprise, for example, structures having substantially planar and/or at least partially curved external surfaces and incorporating one or more evacuated spaces and/or other thermal insulators substantially in a thermal path between the external surfaces (and/or portions thereof) to restrict convective heat transfer so that discrete temperature (and hence solubility) zones may form in the fluid. The thermal insulators may comprise, for example, rubber, plastic and/or fibrous materials having low thermal conductivity relative to solvent fluids intended for use.

Insulated baffle means is primarily designed to provide the necessary temperature difference between fluid zones for effective cleaning and solvent replenishing. The insulated baffle is also used to enhance cleaning action by, for example, directing the convective flow of a stream of relatively clean solvent fluid to an article to be cleaned, possibly increasing flow velocity by decreasing stream cross-sectional area and/or by other means. Articles to be cleaned preferably rest on support means comprising stationary or adjustable shelves, or they may be rotated and/or translated during cleaning by support means which comprise a robotic manipulator. Note that the size and/or location of holes or ports in individual baffles and/or the size and configuration of gaps between baffles and/or between pressure vessel walls and baffles comprising insulated baffle means, as well as individual baffle surface contours and/or orientations with respect to a pressure vessel may be individually or collectively adjustable (as by closed loop control systems and/or by thermally active elements such as, for example, bimetallic elements analogous to those within a thermostat). Such adjustments may preferably be made, for example, to facilitate modification of convective fluid flow velocities and/or patterns, and/or contaminant dissolving power of solvent fluid, and/or contaminant separation from solvent fluid. Such baffle adjustments may be made in substantially real time to, for example, either accentuate or attenuate convective fluid flow characteristics to achieve, for example, improved cleaning action and/or improved contaminant concentration and/or recovery functions.

Static baffles are also useful for the economical and highly reliable operation of the cleaner. Different designs can provide cleaning performance benefits. For example, a baffle with only a center hole effects mass transfer through oscillating, pulsed flow in which the hot fluid surges through the hole, mixes rapidly with the cold fluid (decreasing the contaminant concentration in the cold fluid), and then the cold fluid surges into the hot zone with the cold fluid plume transferring the contaminant to the separation zone. Alternately, a baffle with an outer open ring and center hole permits hot fluid to flow though the outer ring and cold fluid downward through the center hole; thus causing first-in first-out mass transfer.

Insulated baffle means (whether adjustable or non-adjustable) may also be used to facilitate removal of contaminants from contaminated solvent fluid by, for example, directing the flow of a stream of solvent fluid containing one or more dissolved contaminants toward a heat source or sink (that is, heating means or cooling means, respectively) which will raise or lower the solvent fluid temperature sufficiently to cause the desired contaminant separation. Precipitated contaminants may, in turn, be allowed to settle out of the stream by increasing stream cross-sectional area and slowing stream velocity, or they may be superconcentrated using, for example, a screen separator, demister, impinger, separatory funnel, maze of tortuous return flow channels, or cyclone as the stream is directed to travel a curved path by insulated baffle means. These devices could be mounted directly to the baffle, for example in the first-in, first-out baffle configuration a mechanical filter could be mounted to the ring opening to collect particulates (for example, precipitated contaminant, inorganic materials, dust, or metal shavings) or coalescing liquid contaminant droplets before returning the clean hot fluid to the cold zone. Another configuration is to have a side piping to the main cleaning chamber in which a heat exchanger is located. The supercritical fluid would move through this side piping via natural convection currents. The filters, impingers, or cyclone could be located within this piping to help segregate the contaminants from the supercritical fluid (much like the behavior of a steam trap in a pipe flowing steam). Contaminants which have been concentrated by separation and/or those which have been superconcentrated by one or more of the above methods are intermittently or continuously removed from the cleaning apparatus via recovery means (such as, for example, a sump drain valve or a pressure lock for removing semisolid contaminants) positioned within a pressure vessel port to recover the contaminants.

Thus, preferred embodiments of the invention include an apparatus for removing contaminants from an article to be cleaned, the apparatus comprising a pressure vessel and support means within the pressure vessel for supporting the article to be cleaned. Heating means within the pressure vessel facilitate convective flow of a solvent fluid within the pressure vessel, and cooling means within the pressure vessel (which are spaced apart from the heating means) also facilitate convective flow of a solvent fluid within the pressure vessel. Finally, insulated baffle means within the pressure vessel are positioned between the heating means and the cooling means for maintaining at least one temperature difference between zones in a solvent fluid within the pressure vessel.

Note that first and second heating means (or a plurality of heating means) spaced apart within the pressure vessel, and/or first and second cooling means (or a plurality of cooling means) spaced apart within the pressure vessel and apart from the heating means, may also be used to facilitate convective flow of a solvent fluid within the pressure vessel. Note also that heating and/or cooling means within the pressure vessel and spaced apart from any other heating or cooling means may be used to facilitate separation of contaminants from a fluid within the pressure vessel. In certain embodiments of the improved cleaner, heating means and/or cooling means may serve the dual functions of facilitating both convective fluid flow and separation of contaminants from a solvent fluid.

In any of the above embodiments of the present invention, the insulated baffle means may comprise at least one insulated baffle having an annular gap and a substantially centered hole, and/or at least one insulated baffle having a peripheral hole. Insulated baffle means may also comprise at least one adjustable baffle hole. An improved cleaner may also comprise a fluid within the pressure vessel, the fluid comprising, for example, one or more supercritical and/or a near-supercritical fluids.

The invention also includes a method of facilitating fluid flow within a pressure vessel. The method comprises heating a first portion of the fluid with heating means and cooling a second portion of the fluid with cooling means. A portion of the heated first fluid portion is separated from a portion of the cooled second fluid portion with insulated baffle means for maintaining at least one temperature difference between fluid zones within the pressure vessel to facilitate convective fluid flow within the pressure vessel. The invention further includes a method of directing fluid flow within a pressure vessel, the method comprising the above steps followed by directing at least a portion of the convective fluid flow within the pressure vessel using insulated baffle means. The fluid referred to in these methods may of course comprise one or more supercritical and/or near-supercritical fluids.

Another method included in the present invention is a method of removing contaminants from an article to be cleaned using a solvent fluid within a pressure vessel. The method comprises supporting the article to be cleaned with support means within the pressure vessel, heating a first portion of the fluid within the pressure vessel with heating means, and cooling a second portion of the fluid within the pressure vessel with cooling means. A portion of the heated first fluid portion is separated from a portion of the cooled second fluid portion with insulated baffle means within the pressure vessel for maintaining at least one temperature difference between zones in the fluid to facilitate convective fluid flow within the pressure vessel. And insulated baffle means direct at least a portion of the convective fluid flow toward the article to be cleaned to remove contaminants from the article.

Another method of the present invention is that for concentrating contaminants removed from an article to be cleaned using a fluid within a pressure vessel. The method comprises removing contaminants from the article to be cleaned by the above method and then concentrating by separation in the convective fluid flow at least a portion of the removed contaminants from the fluid by heating or cooling the fluid at a location within the pressure vessel and spaced apart from the article to be cleaned. Contaminants removed from an article and concentrated as above may be superconcentrated within a pressure vessel. Methods to accomplish this comprise directing by insulated baffle means at least a portion of the convective fluid flow comprising precipitated contaminants toward separation means comprising, for example, a separatory finnel, a screen separator and/or a cyclone separator within the pressure vessel and superconcentrating at least a portion of the precipitated contaminants by separation within the separatory funnel, the screen separator and/or the cyclone separator.

DETAILED DESCRIPTION

Alternative Preferred Embodiments

Figure 1:
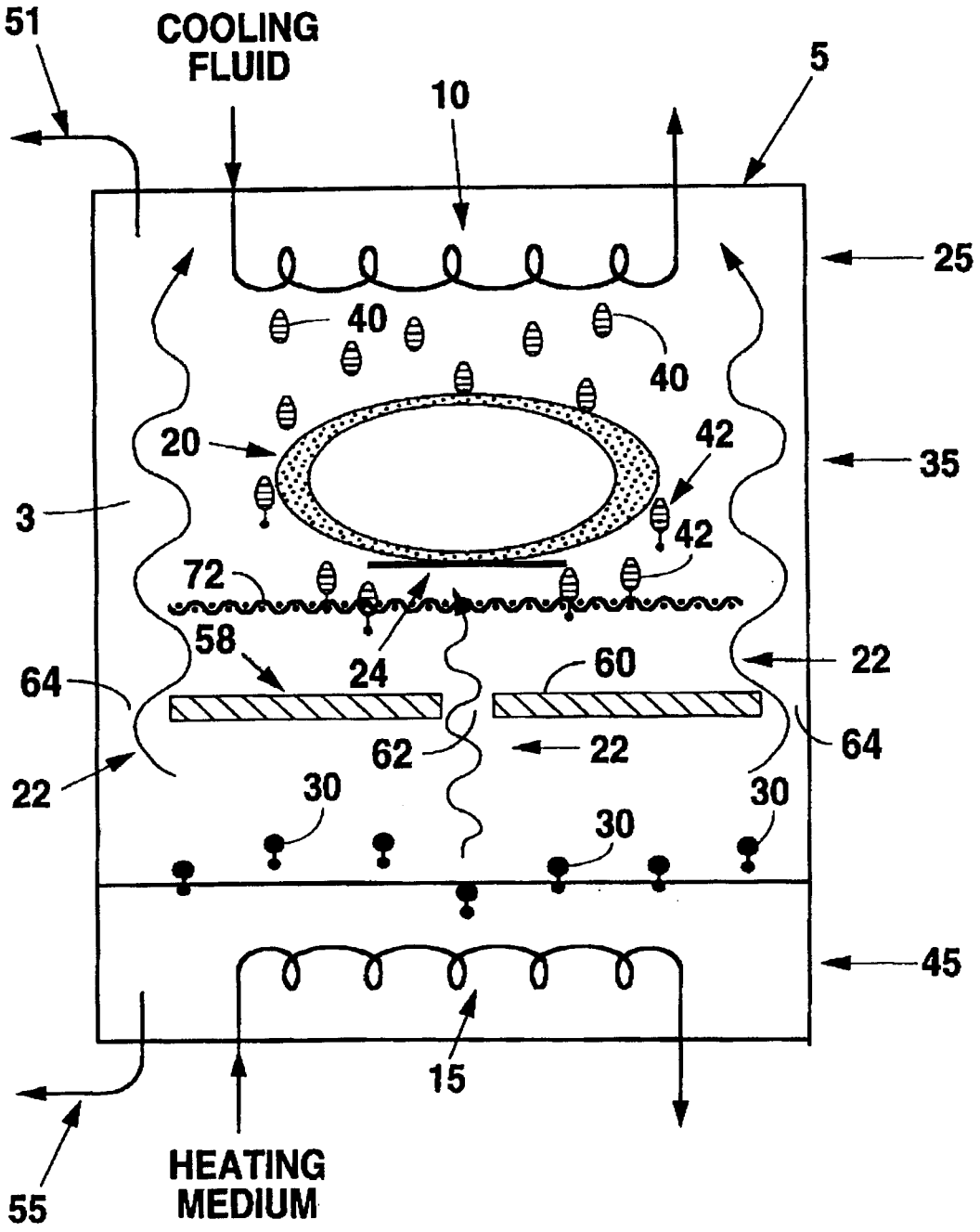
FIG. 1 schematically illustrates one embodiment of the present invention with cooling means above the cleaned part and heating means below the cleaned part.

One preferred embodiment of the present invention includes a process for removing a contaminant from an article. First, the article to be cleaned is contacted with a supercritical fluid in which the contaminant is soluble to solubilize the contaminant at a first supercritical temperature. Next, at substantially constant pressure, the solubility of the contaminant in the supercritical fluid is reduced. For pressure regions where the solubility decreases with increasing temperature, the fluid is heated to a second supercritical temperature. For pressure regions where the solubility decreases with decreasing temperature, the fluid is cooled to a second supercritical temperature. After the supercritical fluid with dissolved contaminant has been cooled or heated to a second supercritical temperature to reduce the solubility of the contaminant in the fluid and to precipitate at least a portion of the dissolved contaminant, the precipitated contaminant is recovered.

A second preferred embodiment of the present invention includes a process for removing a contaminant from an article. This process uses supercritical or near-supercritical fluids possibly with cosolvents and/or adjuvants present which at the operating pressure have increasing contaminant solubility with decreasing temperature. In this process, the article is first contacted with a supercritical or near-supercritical fluid in which the contaminant is soluble or in which the fluid steam line can carry it in the convection current. Next, convective flow of the fluid past the article is created between spaced apart heating and cooling means. This is accomplished by cooling with the cooling means, a portion of the fluid to increase the solubility of the contaminant in the cooled fluid and to increase the density of the fluid such that the density change will cause the cooled fluid to flow past the article, dissolve contaminant on the article, and further flow toward the heating zone. At the heating means, a portion of the contaminant-containing fluid is heated to decrease the solubility of the contaminant in the heated fluid to precipitate any excess contaminant in the heated fluid and to decrease the density of the heated fluid to cause it to flow toward the cooling zone. Finally, the precipitated contaminant is removed from the fluid.

A third preferred embodiment of the present invention includes a process for removing a contaminant from an article. Unlike the previous second embodiment which used fluids having increasing contaminant solubility with decreasing temperature, this embodiment uses fluids, which at the operating pressure have increasing contaminant solubility with increasing temperature. In this process, the article is first contacted with a supercritical or near-supercritical fluid in which the contaminant is soluble. Next, convective flow of the fluid past the article is created between heating and cooling means. This is accomplished by heating with the heating means, a portion of the fluid to increase the solubility of the contaminant in the heated fluid and to decrease the density of the fluid such that the density change will cause the heated fluid to flow past the article, dissolve contaminant on the article, and further flow toward the cooling means. At the cooling means, a portion of the contaminant-containing fluid is cooled to decrease the solubility of the contaminant in the cooled fluid to precipitate any excess contaminant in the cooled fluid and to increase the density of the cooled fluid to cause it to flow toward the heating zone. Finally, the precipitated contaminant is removed from the fluid.

A fourth preferred embodiment of the present invention includes apparatus for carrying out the above methods. Such apparatus generally includes a pressure vessel having heating and cooling means for heating and cooling the fluid and insulated baffle means as described herein. Such apparatus also includes means for supporting (and, optionally, translating and/or rotating) the part to be cleaned in the supercritical fluid; rotation of the part permits all sides of the part to be immediately contacted by the stream line of the supercritical fluid, thus aiding solubility and particle entrainment.

Preferred Supercritical and Near-Supercritical Conditions

Near-supercritical temperatures are generally greater than a reduced temperature of about 0.7 of the critical temperature, preferably greater than about 0.8 of the critical temperature, and most preferably greater than about 0.9 of the critical temperature. After at least a portion of the contaminant is dissolved, the contaminant-containing fluid is then cooled or heated to a second supercritical or near-supercritical temperature to reduce the solubility of the contaminant in the supercritical fluid and precipitate at least a portion of the solubllied contaminant. The precipitate is then removed either batchwise or continuously.

"Precipitate" as used herein refers to the amount of contaminant above the solubility limit of the contaminant in the solvent fluid that separates (in a gas, liquid or solid form) from the solvent fluid as the contaminant's solubility is lowered.

The above first and second supercritical or near-supercritical temperatures may generally be any two supercritical or near-supercritical temperatures as long as the solubility of the liquid is lower at the second temperature. Preferably, these temperatures will be selected to facilitate dissolving of the contaminants at the first supercritical or near supercritical temperature and separation of the contaminants at the second supercritical or near supercritical temperature. In addition, it is generally preferred that the second temperature be selected to minimize separation of the contaminant on the part as it is removed at the end of the cleaning process. This usually means that a low solubility of the contaminant at the second temperature is desired. Preferably, the first and second temperatures will be supercritical with respect to the fluid used.

The improved cleaning apparatus of the present invention is generally operated at a substantially constant pressure which is selected along with the temperature to provide the proper differences in contaminant solubility between the first and second supercritical temperatures.

The supercritical or near-supercritical fluid used in the apparatus of the present invention is generally selected for its ability to dissolve the contaminant to be removed. Suitable supercritical or near-supercritical fluids include inert gases, hydrocarbons, fluorocarbons and carbon dioxide. Preferably, the supercritical or near-supercritical fluid used is selected from the group consisting of carbon dioxide and $C_1$ to $C_{10}$ hydrocarbons. Most preferably, the solvent fluid used is a supercritical fluid. The cleaning ability of the fluid may be enhanced by the addition of at least one selected from the group consisting of cosolvents, entrainers, adjuvants and surfactants.

After the cleaning process is completed, the part must be removed from the vessel in a manner that minimizes separation of contaminant on the part. Generally this may be accomplished by precipitating contaminant on a heat transfer device while depressurizing the solvent fluid or by varying the rate of depressurization. In addition, when processing pressure-sensitive parts or electronic components, it is generally necessary to control both pressurization and depressurization rates to avoid damage to these parts or components.

EXAMPLES

The following examples are provided to further illustrate various embodiments of the present invention. Table 1 shows the solubility of naphthalene in supercritical ethylene.

TABLE 1

Solubility of Naphthalene in Supercritical Ethylene

| | Solubility (g/L) | | Approximate Reduced Density (Pγ) | |
|---|---|---|---|---|
| Reduced Temperature: | 1.01 | 1.12 | 1.01 | 1.12 |
| | Reduced Pressure | | | |
| 1.2 | 7.1 | 0.24 | 1.4 | 0.4 |
| 2.0 | 14 | 14 | 1.8 | 1.1 |
| 6.1 | 22 | 150 | 2.1 | 1.9 |

Example 1

The apparatus of this example is shown in FIG. 1 in which pressure vessel 5 comprises heating means 15, cooling means 10, and insulated baffle means 58. Insulated baffle means 58, in turn, comprises a baffle 60 having a substantially centered hole 62 and an annular gap 64, the latter arising from its size and from its spatial relationship with pressure vessel 5. In the present embodiment, heating means 15 and cooling means 10 are shown as coils, but it is understood that any suitable heat transfer means may be used such as flat plates, trays or any other known heat transfer device. In vessel 5 there is the cooling zone 25, cleaning zone 35 and heating zone 45. Naphthalene contaminated part 20 is supported in cleaning zone 35 by support means 24 which is illustrated as a metal screen. Support means 24 may optionally comprise a robotic arm to enhance the exposure of part 20 to the various fluid flows through translation and/or rotation. In the embodiment shown, supercritical fluid 3 is ethylene.

In operation, the system is operated at 60.6 atm (reduced pressure of 1.2) with the cooling zone at 13° C. and the cleaning zone at a temperature between 13° C. and 44° C. At those temperatures, ethylene has a density of 0.305 g/cc and 0.087g/cc, respectively. Consequently, as heating means 15 heats the supercritical ethylene in the heating zone to 44° C., it forms a less dense supercritical ethylene which rises toward the cooling zone as shown by arrows 22. Cooling means 10 cools the supercritical ethylene which increases its density to 0.305 g/cc and at the same time increases its solubility with-respect to naphthalene to 7.1 g naphthalene/liter ethylene. The more dense supercritical ethylene now flows down as indicated by drops 40 to contact part 20 and solubilize some of the contaminant naphthalene. Drops 40 may loosen substantially insoluble particulate contaminants from part 20 and carry them down to be caught on separatory screen 72. As the naphthalene dissolved in supercritical ethylene 42 is heated up, its solubility with respect to naphthalene decreases to 0.24 g naphthalene/liter ethylene, thereby precipitating excess naphthalene 30. The precipitated naphthalene is far more dense than the fluid 3 and falls to the bottom of vessel 5. The naphthalene may be periodically or continuously removed from vessel 5 via recovery means 55. For some contaminants or fluids it may be necessary to use separation means (not shown) such as, for example, a separatory funnel to force settling of the contaminant in the bottom of vessel 5 or a demister. In the event that contaminants less dense than the supercritical fluid are precipitated, they may be periodically or continuously removed via recovery means 55.

While the present invention is mainly directed to removing contaminants that are soluble in the supercritical or near supercritical fluid, the convection action generated may also loosen insolubles which are not caught on separatory screen 72 and which will be removed via recovery means 55,51 depending on their density.

Example 2

Figure 2:
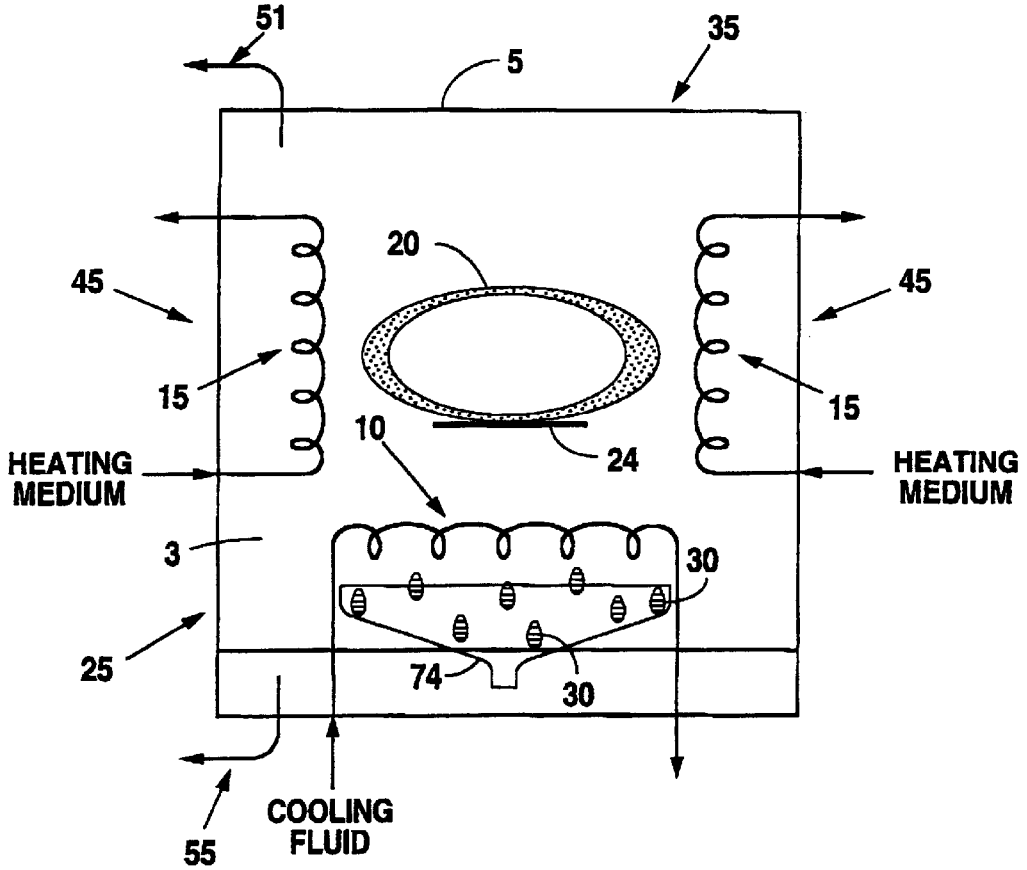
FIG. 2 schematically illustrates an alternative embodiment of the present invention with cooling means below the cleaned part and heating means positions around the part.

The apparatus of this example is shown in FIG. 2 wherein like reference numbers have the same meaning as in FIG. 1. In this example, the system is operated at a pressure of 308.05 atm (reduced pressure of 6.1). Generally for supercritical fluids at higher pressures, the solubility increases with increasing temperature. Since solubilities are generally much greater at the higher pressures, such higher pressures could be utilized for a gross cleaning setup and then a lower pressure such as shown in FIG. 1 could be utilized for final polishing. A portion of excess (precipitating) naphthalene 30 is schematically illustrated as being collected with a separatory fimnel 74.

Since the denser cooler supercritical ethylene (0.458 g/cc) is below the hotter lighter supercritical ethylene (0.414 g/cc), the vigorous convection illustrated in FIG. 1 will be absent. Optionally, this arrangement may be operated by maintaining the pressure substantially constant through the use of the heating means and convection generated by cycling the cooling means on and off. The contaminants would be removed during the cooling cycle. At this pressure, the solubility of naphthalene in ethylene in the 44° C. hot zone and the 13° C. cool zone is 150 g naphthalene/liter ethylene and 22 g naphthalene/liter ethylene, respectively.

Example 3

Figure 3:
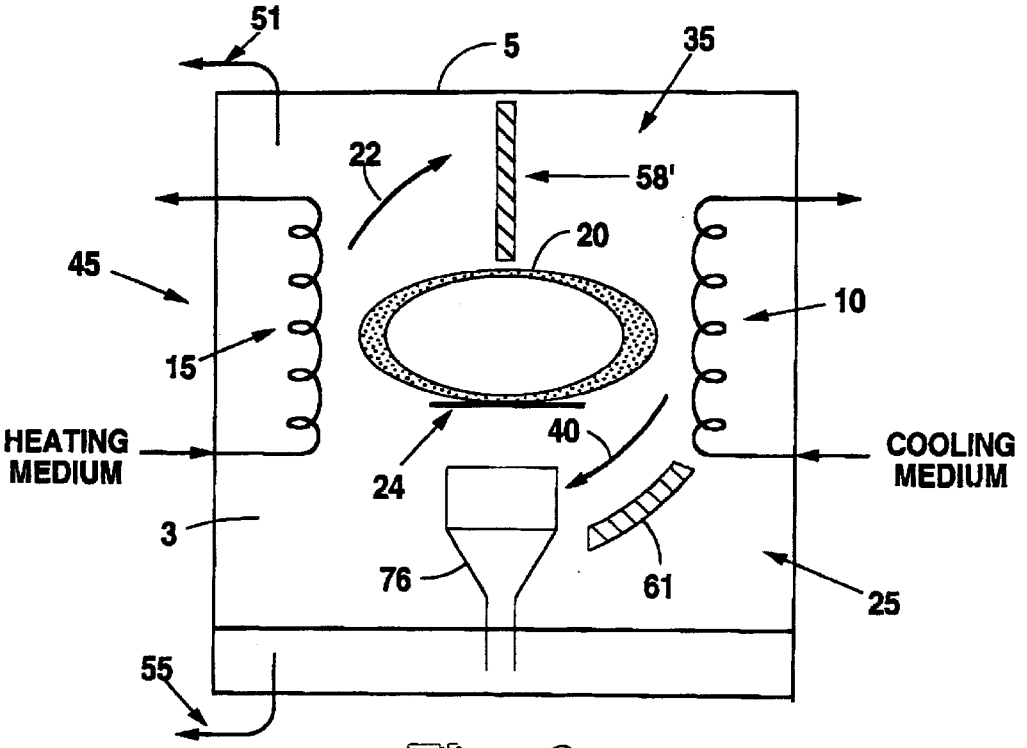
FIG. 3 schematically illustrates another alternative embodiment of the present invention with cooling means to one side of the cleaned part and heating means positioned on the other side of the cleaned part.

The apparatus of this example is shown in FIG. 3 wherein the reference numbers are the same as in FIG. 1. As can been seen in this example, the convective flows 22 and 40 will create a clockwise pattern around part 20, employing the insulated baffle means 58' to maintain a desired temperature difference between zones in the fluid 3. Thus the fluid flow pattern differs from the up and down movement schematically illustrated in FIG. 1 (of course, a counter clockwise pattern may be created by reversing the positions of heating means 15 and cooling means 10). When operating in the pressure regions where the solubility increases with increasing temperature it is desirable to position part 20 near or in stream 22. When operating in the pressure regions where the solubility decreases with increasing temperature it is desirable to position part 20 near or in stream 40. This example is at a reduced pressure of 6.1. In this example, heating means 15 heats the fluid causing it to rise as shown by arrow 22. The ethylene fluid is heated to 44° C. which as shown in Table 1 has a density of 0.414 g/cc and a solubility of 150 g naphthalene/liter ethylene. This heated fluid has the ability to readily dissolve naphthalene as it passes part 20. The naphthalene dissolved in ethylene then reaches cooling means where it is cooled to 13° C., which, as shown in Table 1, has a density of 0.458 g/cc and a solubility of 22 naphthalene/liter ethylene. Thus, cooling will cause precipitation of naphthalene in excess of the 22 g/l value. The naphthalene, having a density of 1.179 g/cc at 13° C., will have a tendency to fall to the bottom of vessel 5, but a portion of the convective fluid flow within vessel 5 will be directed by insulated (and curved) baffle means 61 toward cyclone separator 76 where naphthalene will be superconcentrated. The cooled ethylene that passes around to heating means 15 is heated to continue the cycle.

With the clockwise or counterclockwise convective flow pattern it may be necessary to adjust insulated baffle means and/or screens, funnels and/or cyclone separators to encourage concentration by separation and superconcentration in separation means, and to direct the precipitate away from part 20.

What is claimed is:

1. A method for removing contaminants from a substrate comprising:

placing a substrate comprising contaminants in a pressure vessel;

supplying to said pressure vessel a solvent fluid adapted to remove said contaminants;

heating a first zone of said pressure vessel to an unstable elevated temperature effective to facilitate a first convective flow of said solvent fluid through said first zone and into a second zone of said pressure vessel;

cooling said second zone of said pressure vessel to a cooled temperature effective to facilitate a second convective fluid flow of said solvent fluid through said second zone and into said first zone of said pressure vessel, said cooled temperature also being effective to reduce solubility of said contaminants in said solvent fluid to a level sufficient to cause at least a portion of said contaminants to precipitate from said solvent fluid without requiring depressurization of said pressure vessel;

providing sufficient thermal insulation between said first zone and said second zone of said pressure vessel to maintain said elevated temperature in said first zone and said cooled temperature in said second zone;

wherein said first convective flow and said second convective flow produce a rate of solvent flow through said pressure vessel which is effective to remove said contaminants from said substrate.

2. The method of claim 1 wherein said heating said second zone of said pressure vessel to said elevated temperature comprises heating said first zone to a temperature that is sufficiently high to cause at least some of said contaminants to dissolve in said solvent fluid.

3. The method of claim 1 further comprising positioning said second zone of said pressure vessel gravitationally above said first zone of said pressure vessel.

4. The method of claim 2 further comprising positioning said second zone of said pressure vessel gravitationally above said first zone of said pressure vessel.

5. The method of claim 1 wherein said providing sufficient thermal insulation comprises a providing an insulated baffle separating said first zone and said second zone; and, said method further comprises controlling flow rate of said solvent fluid between said first zone and said second zone by controlling a flowpath for said solvent fluid selected from the group consisting of one or more apertures through said insulated baffle and a gap between a periphery of said baffle and an inner surface of said pressure vessel.

6. The method of claim 1 wherein said providing sufficient thermal insulation comprises providing an insulated baffle separating said first zone and said second zone; and, said method further comprises controlling differences between said elevated temperature and said cooled temperature by controlling said heating, said cooling, and a flowpath for said solvent fluid selected from the group consisting of one or more apertures through said insulated baffle and a gap between a periphery of said baffle and an inner surface of said pressure vessel.

7. The method of claim 2 wherein said providing sufficient thermal insulation comprises providing an insulated baffle separating said first zone and said second zone; and, said method further comprises controlling flow rate of said solvent fluid between said first zone and said second zone by controlling a flowpath for said solvent fluid selected from the group consisting of one or more apertures through said insulated baffle and a gap between a periphery of said baffle and an inner surface of said pressure vessel.

8. The method of claim 2 wherein said providing sufficient thermal insulation comprises providing an insulated baffle separating said first zone and said second zone; and, said method further comprises controlling differences between said elevated temperature and said cooled temperature by controlling said heating, said cooling, and a flowpath for said solvent fluid selected from the group consisting of one or more apertures through said insulated baffle and a gap between a periphery of said baffle and an inner surface of said pressure vessel.

9. The method of claim 3 wherein said providing sufficient thermal insulation comprises providing an insulated baffle separating said first zone and said second zone; and, said method further comprises controlling flow rate of said solvent fluid between said first zone and said second zone by controlling a flowpath for said solvent fluid selected from the group consisting of one or more apertures through said insulated baffle and a gap between a periphery of said baffle and an inner surface of said pressure vessel.

10. The method of claim 3 wherein said providing sufficient thermal insulation comprises providing an insulated baffle separating said first zone and said second zone; and, said method ffurther comprises controlling differences between said elevated temperature and said cooled temperature by controlling said heating, said cooling, and a flowpath for said solvent fluid selected from the group consisting of one or more apertures through said insulated baffle and a gap between a periphery of said baffle and an inner surface of said pressure vessel.

11. The method of claim 1 wherein said solvent fluid is selected from the group consisting of a supercritical fluid and a near supercritical fluid.

12. The method of claim 2 wherein said solvent fluid is selected from the group consisting of a supercritical fluid and a near supercritical fluid.

13. A method for removing contaminants from a substrate comprising:

placing a substrate comprising contaminants in a pressure vessel;

supplying to said pressure vessel a solvent fluid selected from the group consisting of a supercritical fluid and a near supercritical fluid;

heating a first zone of said pressure vessel to an unstable elevated temperature effective to facilitate a first convective flow of said solvent fluid through said first zone and into a second zone of said pressure vessel;

cooling said second zone of said pressure vessel to a cooled temperature effective to facilitate a second convective fluid flow of said solvent fluid through said second zone and into said first zone of said pressure vessel, said cooled temperature also being effective to reduce solubility of said contaminants in said solvent fluid to a level sufficient to cause at least a portion of said contaminants to precipitate from said solvent fluid without requiring depressurization of said pressure vessel;

positioning said second zone of said pressure vessel above said first zone of said pressure vessel;

providing sufficient thermal insulation between said first zone and said second zone of said pressure vessel to maintain said unstable elevated temperature and said cooled temperature;

wherein said first convective flow and said second convective flow produce a rate of solvent flow through said pressure vessel which is effective to remove said contaminants from said substrate.

14. The method of claim 4 wherein said solvent fluid is selected from the group consisting of a supercritical fluid and a near supercritical fluid.

15. The method of claim 5 wherein said solvent fluid is selected from the group consisting of a supercritical fluid and a near supercritical fluid.

16. The method of claim 6 wherein said solvent fluid is selected from the group consisting of a supercritical fluid and a near supercritical fluid.

17. The method of claim 7 wherein said solvent fluid is selected from the group consisting of a supercritical fluid and a near supercritical fluid.

18. The method of claim 8 wherein said solvent fluid is selected from the group consisting of a supercritical fluid and a near supercritical fluid.

19. The method of claim 9 wherein said solvent fluid is selected from the group consisting of a supercritical fluid and a near supercritical fluid.

20. The method of claim 10 wherein said solvent fluid is selected from the group consisting of a supercritical fluid and a near supercritical fluid.

21. The method of claim 1 further comprising collecting and removing precipitated contaminants from said second zone.

* * * * *

UNITED STATES PATENT AND TRADEMARK OFFICE

CERTIFICATE OF CORRECTION

PATENT NO. : 6,165,282
DATED : December 26, 2000
INVENTOR(S) : Marshall et al.

It is certified that error appears in the above-identified patent and that said Letters Patent is hereby corrected as shown below:

Claim 2,
Line 46, is corrected to read as follows:

The method of claim 1, wherein said heating said [second] -- first --

Signed and Sealed this

Twenty-third Day of October, 2001

*Attest:*

Nicholas P. Godici

*Attesting Officer*

NICHOLAS P. GODICI
*Acting Director of the United States Patent and Trademark Office*